US008695822B2

(12) United States Patent
Kwon

(10) Patent No.: US 8,695,822 B2
(45) Date of Patent: Apr. 15, 2014

(54) CONTAINER FOR PREVENTING LOSS OF STOPPER AND IDLE ROTATION THEREOF

(76) Inventor: Si-Joong Kwon, Bucheon-si (KR)

( * ) Notice: Subject to any disclaimer, the term of this patent is extended or adjusted under 35 U.S.C. 154(b) by 37 days.

(21) Appl. No.: 13/574,094

(22) PCT Filed: Jan. 1, 2011

(86) PCT No.: PCT/KR2011/000001

§ 371 (c)(1),
(2), (4) Date: Jul. 19, 2012

(87) PCT Pub. No.: WO2011/090278

PCT Pub. Date: Jul. 28, 2011

(65) Prior Publication Data

US 2012/0285921 A1 Nov. 15, 2012

(30) Foreign Application Priority Data

Jan. 25, 2010 (KR) ..... 10-2010-0006715
Mar. 23, 2010 (KR) ..... 10-2010-0026011

(51) Int. Cl.
*B65D 41/04* (2006.01)

(52) U.S. Cl.
USPC ..... 215/330; 215/252; 215/258; 220/833

(58) Field of Classification Search
USPC ..... 215/252, 258, 235, 330, 331, 306; 220/833, 834, 375, 268; 222/541.5, 222/541.6, 153.01, 153.14
See application file for complete search history.

(56) References Cited

U.S. PATENT DOCUMENTS

| | | | | |
|---|---|---|---|---|
| 5,215,204 | A | 6/1993 | Beck et al. | |
| 5,853,095 | A | 12/1998 | Marshall et al. | |
| 5,944,207 | A * | 8/1999 | Reidenbach | 215/243 |
| 5,984,123 | A * | 11/1999 | Mogami et al. | 215/235 |
| 6,474,491 | B1 | 11/2002 | Benoit-Gonin et al. | |
| 2005/0173368 | A1 | 8/2005 | Nusbaum et al. | |

FOREIGN PATENT DOCUMENTS

| | | |
|---|---|---|
| KR | 10-0855086 B1 | 8/2008 |
| KR | 10-0894341 B1 | 4/2009 |
| KR | 10-0942642 B1 | 2/2010 |

OTHER PUBLICATIONS

International Search Report of International Application No. PCT/KR2011/000001, dated Sep. 26, 2011.

* cited by examiner

*Primary Examiner* — Steven A. Reynolds
*Assistant Examiner* — Ernesto Grano
(74) *Attorney, Agent, or Firm* — Kile Park Reed & Houtteman PLLC

(57) ABSTRACT

A container for preventing a container cap from being lost and for preventing unintended rotation thereof about a mouth of the container. Maintaining a stable posture of the an opened container cap to enhance use of an opened container.

9 Claims, 15 Drawing Sheets

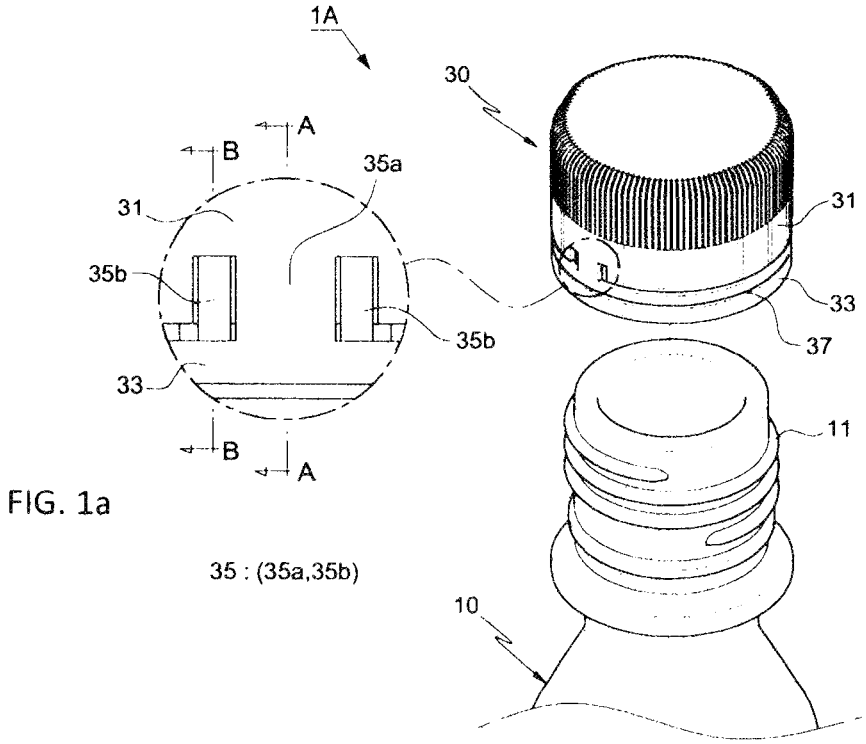
FIG. 1a
FIG. 1
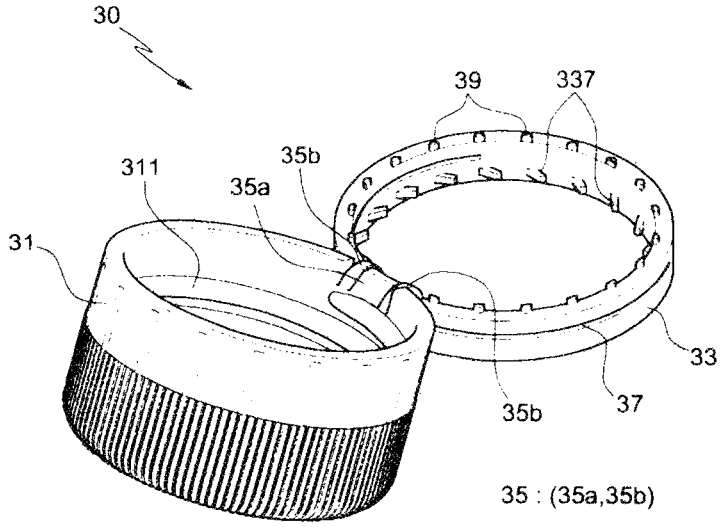
FIG. 2

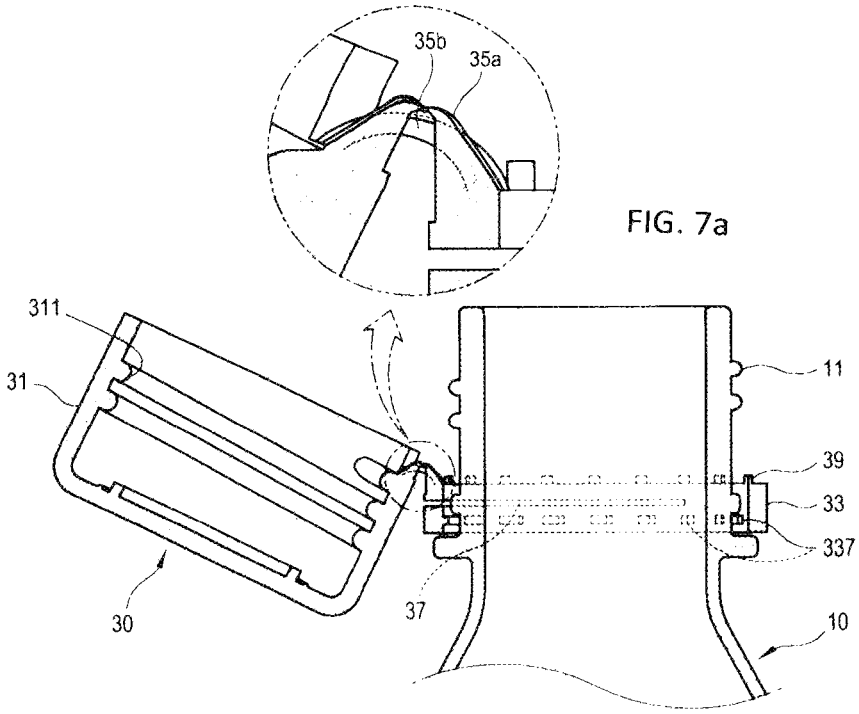
FIG. 7a
FIG. 7
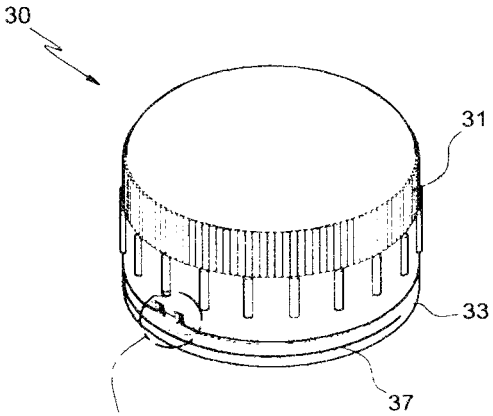
FIG. 8
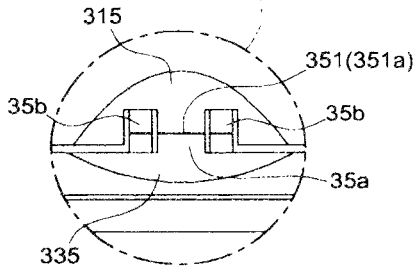
FIG. 8a

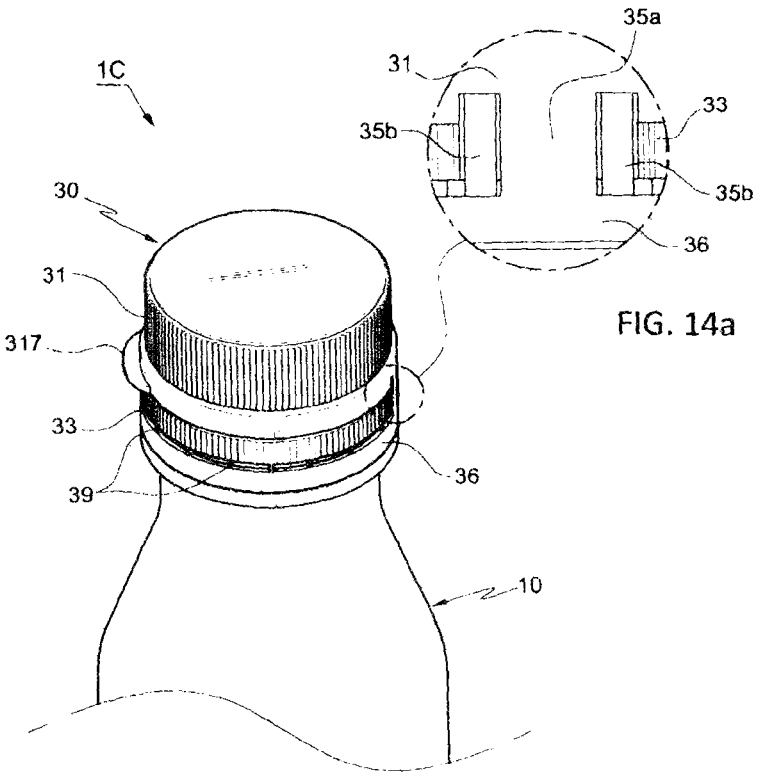
FIG. 14a
FIG. 14
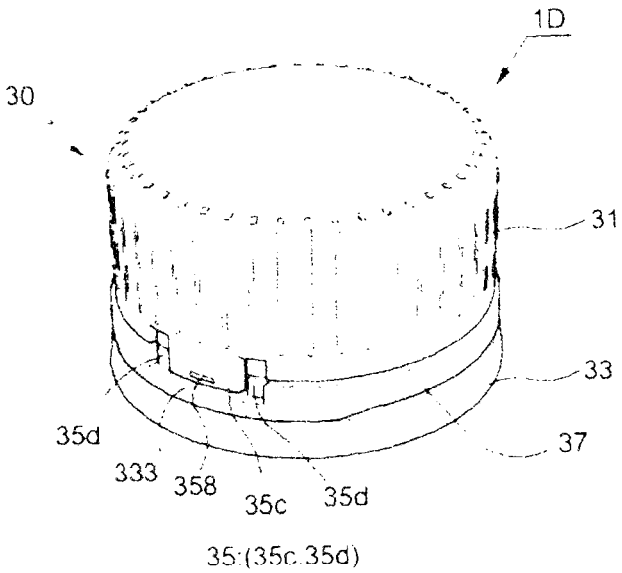
FIG. 15

CONTAINER FOR PREVENTING LOSS OF STOPPER AND IDLE ROTATION THEREOF

TECHNICAL FIELD

The present invention relates to a container for preventing loss of a container cap and unintended loose rotation thereof, by preventing wobbling of a container cap body by means of a sub-connector formed at either side of a main connector, in a state where the cap is open, maintaining a stable posture of the opened container cap to thus enhance the feeling of use, and preventing an undercut from being formed at an inner side of the container cap due to a hinge portion.

BACKGROUND ART

In general, a container that contains liquid materials of oil, paint and chemical products as well as beverages such as water and milk, includes a container body having a mouth, and a cap that opens and closes the mouth of the container body. The cap can be generally classified into a screw-coupling type or a one-touch type according to an opening and closing structure.

In the case of a screw-coupling type cap 130, shown in FIGS. 18 and 19, a female screw portion is formed on an inner circumferential surface of the cap 130 in correspondence to a container body 110 on which a male screw portion is formed on an outer circumferential surface of the mouth of the container body 130. In the case that the cap is completely separated from the container body, it may be polluted or lost. Accordingly, a fixing ring 133 for preventing the cap from being separated from the container body 110 is provided at the lower portion of a cap body 131 so that the cap is maintained to connect with the container body at the time of opening a container 100.

In addition, the cap body 131 and the fixing ring 133 are connected by a plurality of bridges 135 that are radially formed. When the cap is opened, the bridges 135 are separated to then enable a user to recognize whether or not the container 100 has been opened.

Since the fixing ring 133 is combined with the container body 110 so as to rotate in the above-described conventional technology, the opened cap body 131 rotates together with the fixing ring 133, and the cap body 130 is located downwards by dead weight at the time of pouring the contents, and then caught by the mouth or chin of the user, to thereby provide the user with the feelings of discomfort and burdens and cause dirtiness due to the cap polluted by the contents.

Meanwhile, in the case of a one-touch type cap 130A shown in FIG. 20, a fixing ring 133*a* that is fixed to a container body and a cap body 131*a* that performs opening and closing operations are connected by a hinge portion 135*a*.

The hinge portion 135*a* is formed thinly in thickness and with a stepped portion, in comparison with the cap body 131*a* and the fixing ring 133*a*. A width of the hinge portion 135*a* that connects between the cap body 131*a* and the fixing ring 133*a* is formed in a fashion that the width becomes gradually large as it goes toward both sides of the hinge portion from the middle portion of the hinge portion in correspondence to spaces between the cap body 131*a* and the fixing ring 133*a* at the time of opening the cap of the container. Accordingly, the cap body can be stably connected with the container body at the time of opening.

However, since a deep stepped portion, that is, an undercut portion is formed on the inner circumferential surface of the cap due to the hinge portion 135*a*, the fixing ring 133*a* and the cap body 131*a* are injection-molded inevitably in an unfolded form at a state where the hinge portion 135*a* is interposed between the fixing ring 133*a* and the cap body 131*a*. Thus, an area of a mold for producing a single cap becomes as wide as two times or more. As a result, the number of caps that can be produced through a single mold falls down to the half or less, to thus halve productivity of the mold.

On one hand, since the fixing ring 133*a* and the cap body 131*a* are injection-molded in the unfolded form, they are cut at the time of opening the container, to thus cause a defect of employing no structure that allows a user to check whether or not the cap is open.

On the other hand, the screw-coupling type cap having the bridges according to the conventional art has a difficulty of injection molding due to an undercut portion to thereby make it difficult to perform a stable connection between the cap and the container and to realize the hinge portion that does not cause the cap body to be shaken at the time of opening, as in the case of a one-touch type cap.

To solve the above problems or defects, it is an object of the present invention to provide a container for preventing loss of a container cap and unintended loose rotation thereof, by preventing loose rotation or wobbling of a container cap body by means of a sub-connector formed at either side of a main connector, at a state where the container cap is open, maintaining a stable posture of the opened container cap to thus remarkably enhance the feeling of use.

It is another object of the present invention to provide a container for preventing loss of a container cap and idle rotation thereof, by preventing an undercut from being formed at the inner side of the container cap due to a hinge portion to thus reduce occurrence of inferiority through easy injection molding and to thereby double productivity of the container cap through the injection molding.

To accomplish the above and other objects of the present invention, according to an aspect of the present invention, there is provided a container for preventing loss of a container cap and idle rotation thereof, the container comprising:

a container body having a mouth provided with a male screw portion;

a fixing ring that is prevented from seceding from the container body;

a container cap body on the inner circumferential surface of which a female screw portion is provided in correspondence to the male screw portion of the container body; and a container cap provided with a hinge portion connecting the fixing ring with the container cap body, wherein the hinge portion of the container cap comprises:

a main connector that connects the container cap body and the fixing ring; and a sub-connector formed at either side of the main connector and having a narrower width than the main connector, wherein a portion of the main connector connected to the container cap body and the fixing ring is formed into the same thickness as those of the container cap body and the fixing ring, and wherein the main connector has an inflection portion that is depressed in a curvature form or in a "v-shaped" form inwardly or outwardly at an intermediate portion in height, to thereby have minimum thickness.

Preferably but not necessarily, a cutting line for extending a connection length with respect to the container cap body is horizontally formed on the fixing ring in a section where the container cap can be opened while maintaining a state where the container cap body has been connected with the fixing ring, at a state where the fixing ring is fixed by a support projection of the container body around directly below the hinge portion.

Preferably but not necessarily, the container is characterized in that: a female screw portion corresponding to the male screw portion of the container body is formed on the inner circumferential surface of the fixing ring; indent locking portions that correspond to each other are formed between the container cap body and the fixing ring at a position corresponding to the hinge portion; locks that correspond to each other are protrudingly formed on the inner circumferential surface of the fixing ring and the upper portion of the screw portion of the container body, in order to prevent the fixing ring from seceding from the container body; and the locks are provided in a ratchet form in order not to interfere with rotation of the container cap in a locking direction.

Preferably but not necessarily, the container further comprises: a sub-fixing ring that is caught by the support projection that is formed in the container body and that is prevented from moving upward below the fixing ring, wherein one or more bridges that are cut at the time of opening the container cap are formed between the fixing ring and the sub-fixing ring.

According to another aspect of the present invention, there is also provided a container for preventing loss of a container cap and unintended loose rotation thereof, the container comprising:

a fixing ring that is prevented from seceding from a container body;

a container cap body that opens and closes the container body, and on the inner circumferential surface of which a screw portion is formed;

a hinge portion that connects the fixing ring and the container cap body; and a plurality of bridges that are formed between the container cap body and the fixing ring and are cut at the time of opening the container cap, wherein a cutting line for extending a connection length with respect to the container cap body at the time of opening the container cap is formed on the fixing ring in a set section of the circumference of the fixing ring around directly below the hinge portion, wherein the hinge portion comprises: a stay that is extended toward the fixing ring from the container cap body, is spaced from the fixing ring, and comes into the inside thereof at the time of opening the container cap, to thus maintain the opened state; and connectors that connect the container cap body and the fixing ring, and wherein a plurality of support wings are formed on the inner circumferential surface of the fixing ring, in which a cushion pad that is extended from the stay, to thus erect upright at the time of being mounted on the container body and elastically support the stay at the time of opening the container cap is formed adjacent to the stay.

In the case of a container for preventing loss of a container cap and unintended loose rotation thereof, having the above-described structure according to the present invention, inner surfaces of a main connector and sub-connectors that form a hinge portion are formed on the same plane as that of a container cap, and parts of a container cap body and a fixing ring that are located in the neighborhood of the hinge portion are depressed into an inclined plane, respectively. Accordingly, the container cap is smoothly opened and an undercut portion is prevented from being formed at the inner side of the container cap due to the hinge portion to thus reduce occurrence of inferiority through easy injection molding with respect to vertical connection between the fixing ring and the container cap body and to thereby double productivity of the container cap through the injection molding.

In addition, the fixing ring is screw-coupled with the container body and is rotated and escalated along screw threads together with the container cap body and the fixing ring is prevented from seceding by locks, to thus prevent loss of the container cap and maintain a stable posture of the opened container cap by a holder, and to thereby remarkably enhance the feeling of use.

In addition, a stay and a cushion pad are provided in the hinge portion, to thus make the cushion pad support the stay elastically at the time of opening the container cap, and to thereby make the container cap softly opened and maintain a stable opening angle of the container cap.

THE DRAWINGS

FIG. 1 is an exploded perspective view of a container for preventing loss of a container cap and idle rotation thereof according to an embodiment of the present invention.

FIG. 1*a* is an enlarged detail view of a circled portion of FIG. 1.

FIG. 2 is a perspective view showing a container cap opening state of FIG. 1.

Figure 3:
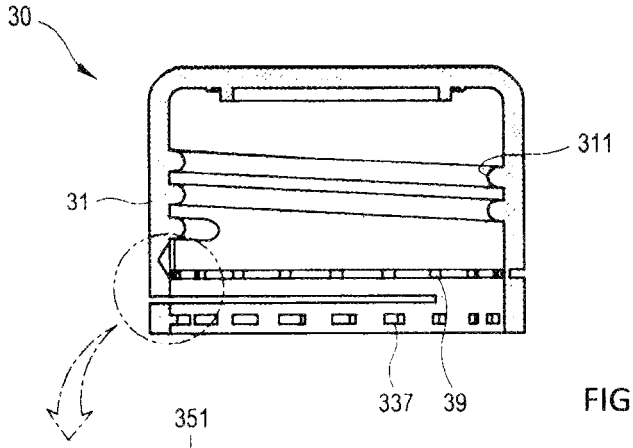
FIG. 3 is a cross-sectional view cut along a line "A-A" of FIG. 1.
Figure 3A:
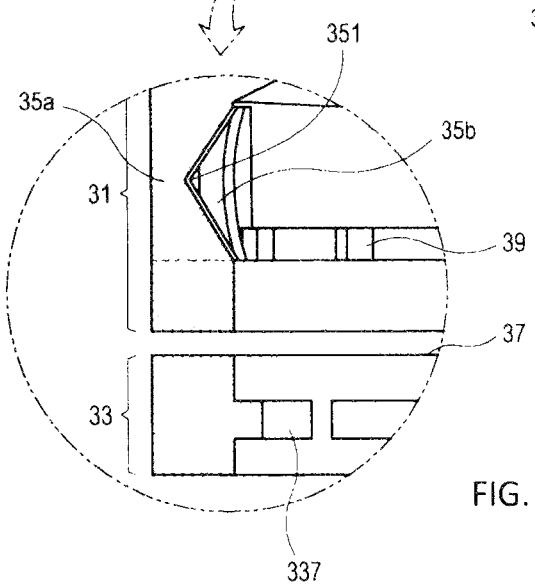

FIG. 3*a* is an enlarged detail view of a circled portion of FIG. 3.

Figure 4:
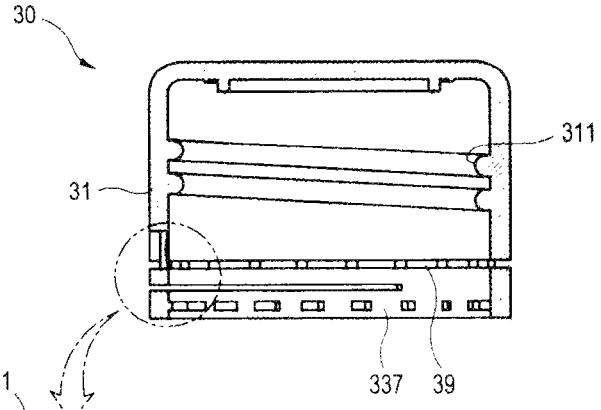

FIG. 4 is a cross-sectional view cut along a line "B-B" of FIG. 1.

Figure 4A:
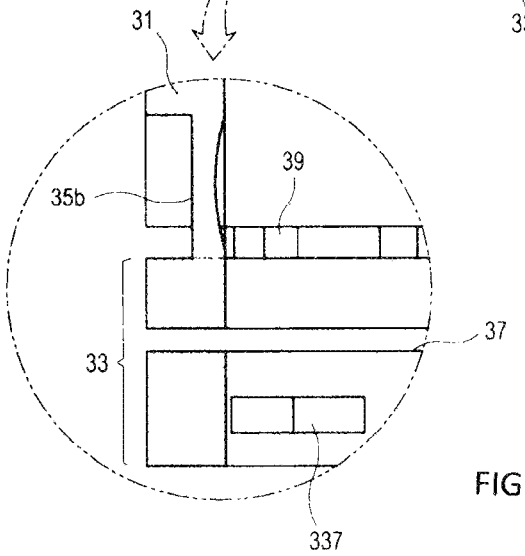

FIG. 4*a* is an enlarged detail view of a circled portion of FIG. 4.

Figure 5:
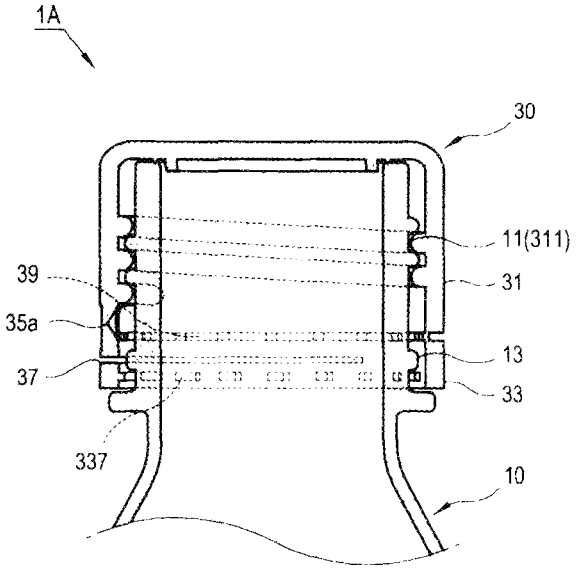

FIG. 5 is a perspective view showing a container cap closing state of FIG. 1.

Figure 6:
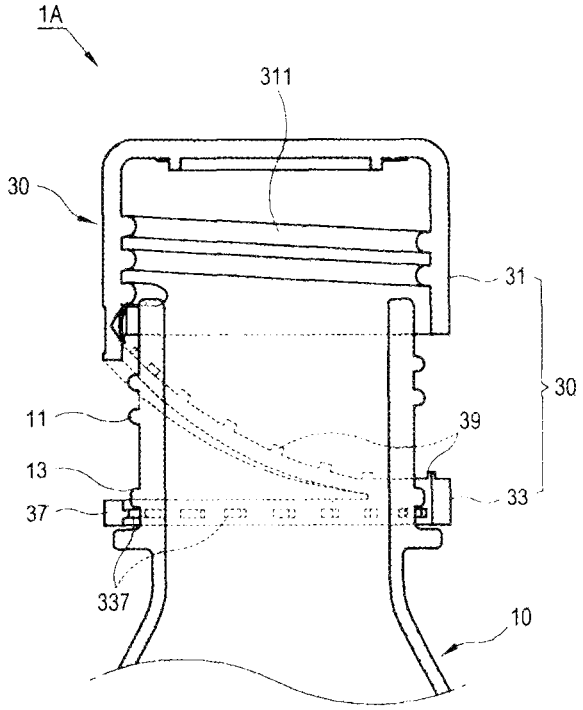

FIG. 6 is a cross-sectional view showing a first step of the container cap opening state of FIG. 5.

FIG. 7 is a cross-sectional view showing a second step of the container cap opening state of FIG. 5.

FIG. 7*a* is an enlarged detail view of a circled portion of FIG. 7.

FIG. 8 is a perspective view showing a container cap that is employed in the container according to the embodiment of the present invention.

FIG. 8*a* is an enlarged detail view of a circled portion of FIG. 8.

Figures 9, 9A:
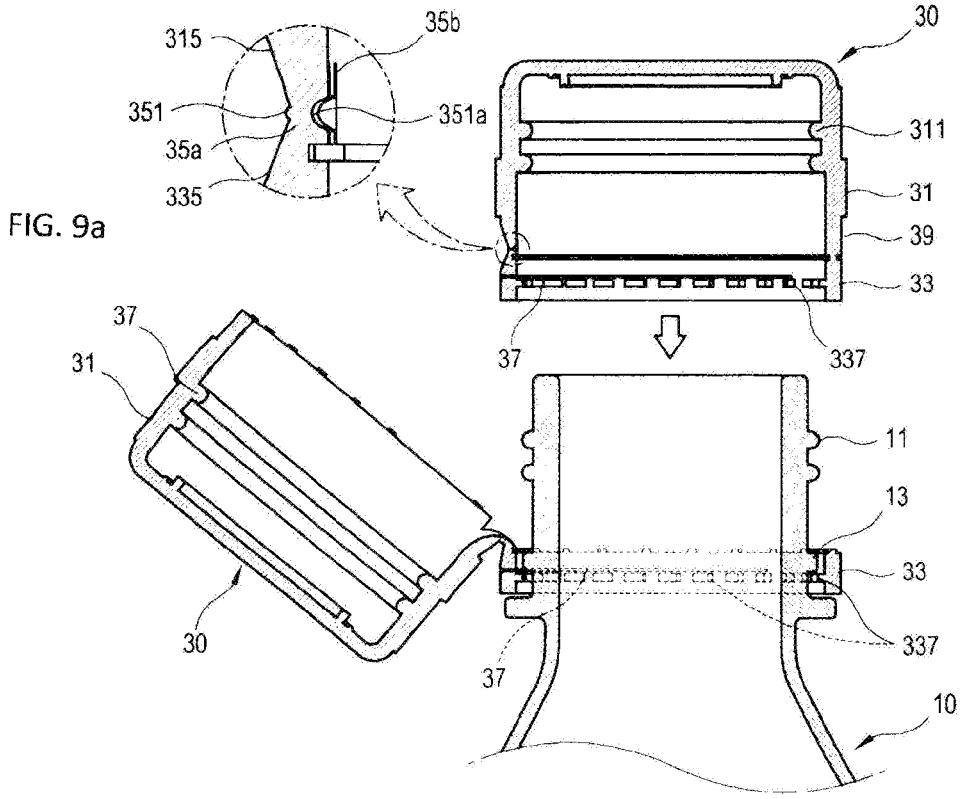

FIG. 9 is a cross-sectional view showing the container cap of FIG. 8 that is applied for a container.

FIG. 9*a* is an enlarged detail view of a circled portion of FIG. 9.

FIG. 10 is an exploded perspective view of a container for preventing loss of a container cap and unintended loose rotation thereof according to another embodiment of the present invention.

Figures 10A, 10B:
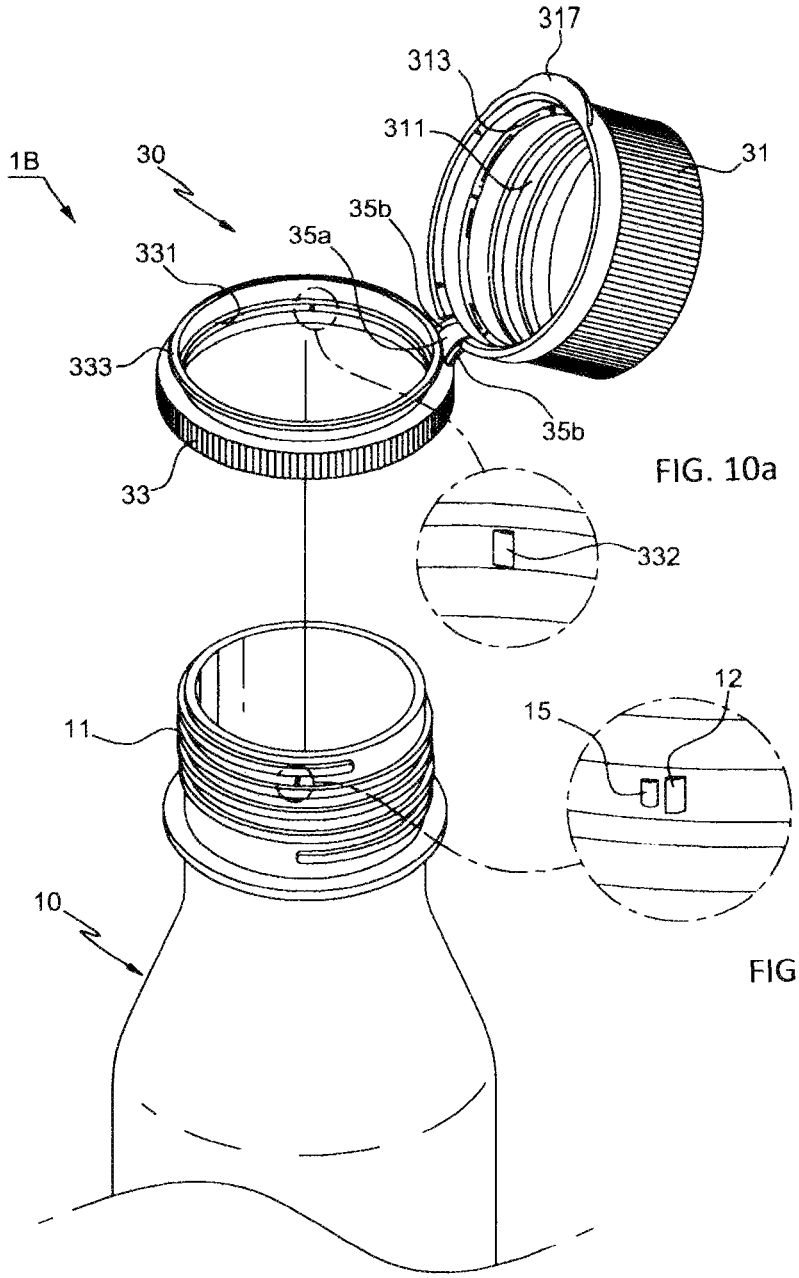

FIG. 10*a* is an enlarged detail view of a circled portion of FIG. 10.

FIG. 10*b* is an enlarged detail view of a circled portion of FIG. 10.

Figures 11, 11A:
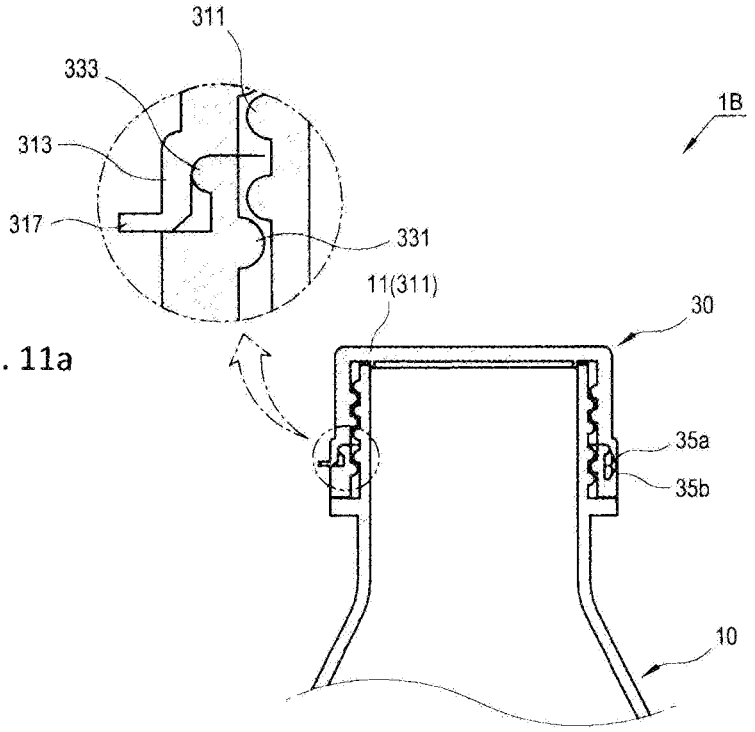

FIG. 11 is a perspective view showing a container cap closing state of FIG. 10.

FIG. 11*a* is an enlarged detail view of a circled portion of FIG. 11.

Figure 12:
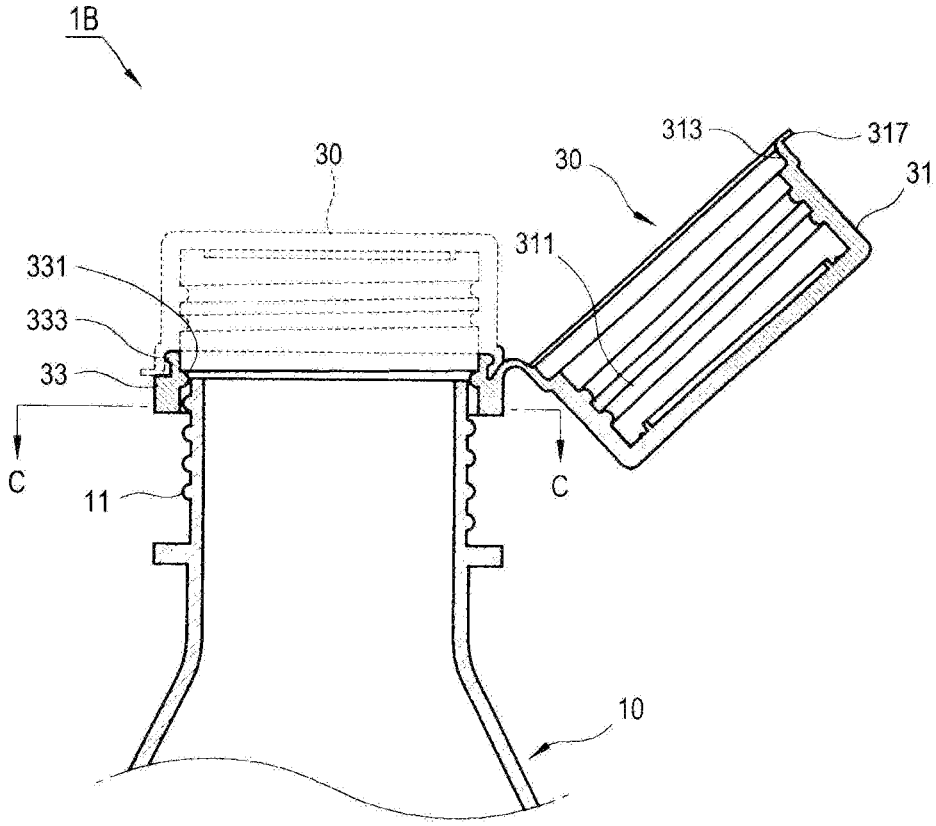

FIG. 12 is a cross-sectional view showing a container cap opening state of FIG. 11.

Figures 13, 13A:
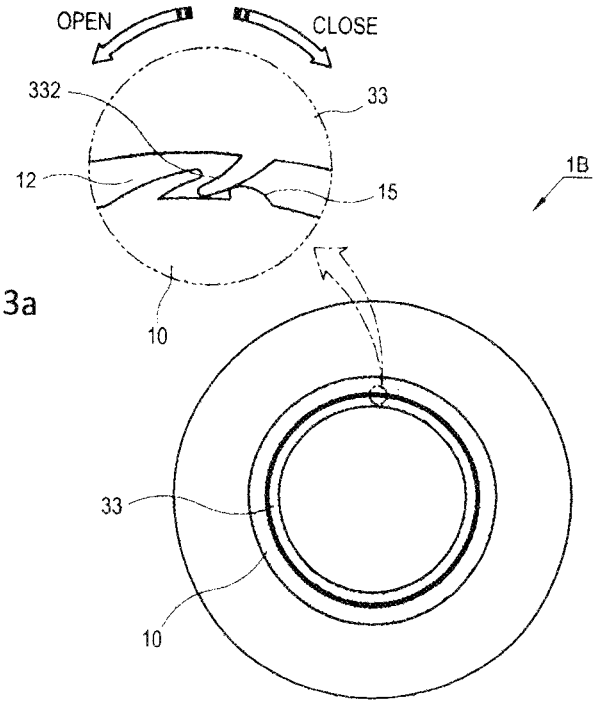

FIG. 13 is a cross-sectional view cut along a line "C-C" of FIG. 12.

FIG. 13*a* is an enlarged detail view of a circled portion of FIG. 13.

FIG. 14 is an exploded perspective view of a container for preventing loss of a container cap and unintended loose rotation thereof according to still another embodiment of the present invention.

FIG. 14*a* is an enlarged detail view of a circled portion of FIG. 14.

FIG. 15 is a perspective view showing a container cap that is employed in the container according to the still another embodiment of the present invention.

Figure 16:
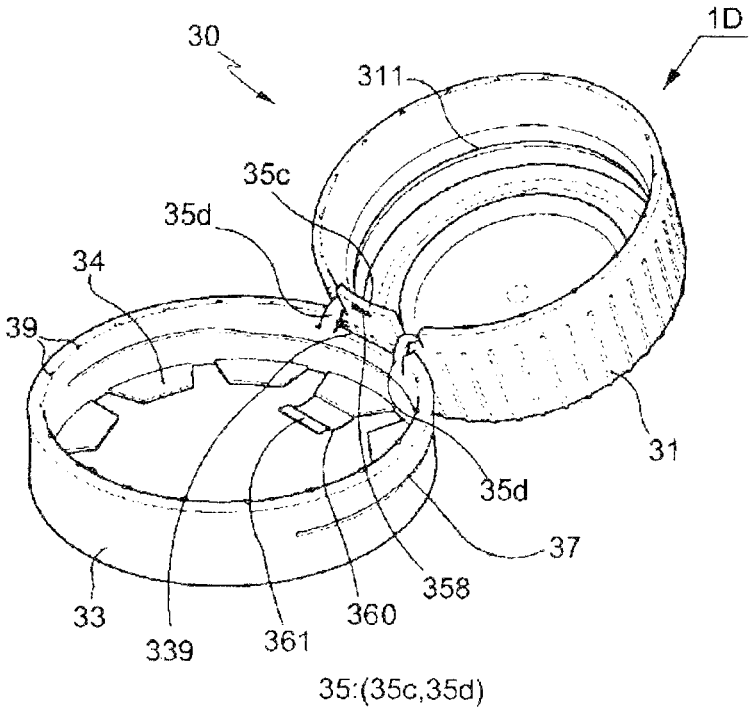

FIG. 16 is a perspective view showing a container cap opening state of FIG. 15.

Figures 17, 17A:
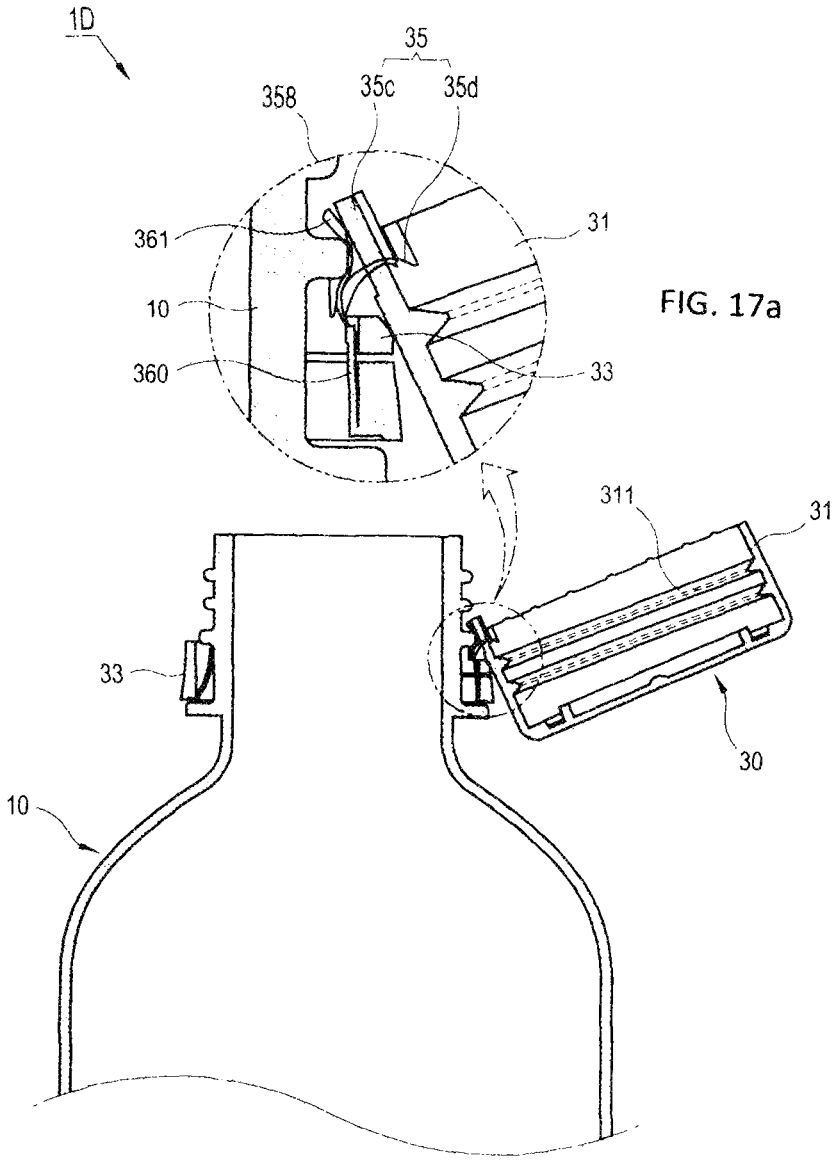

FIG. 17 is a cross-sectional view showing an opening state of the container cap of FIG. 15 that is employed in a container.

FIG. 17*a* is an enlarged detail view of a circled portion of FIG. 17.

Figure 18:
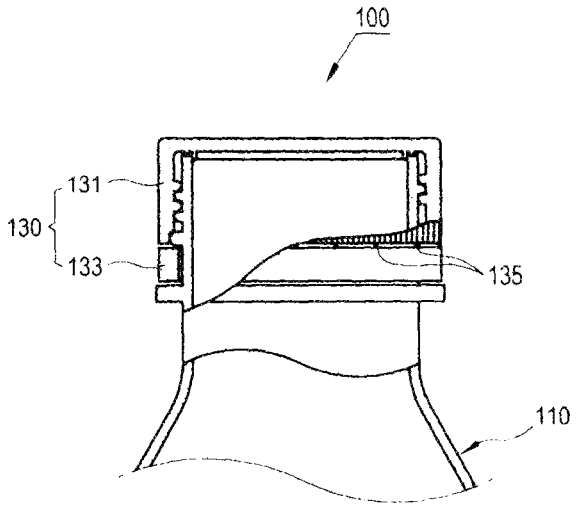
FIG. 18 (PRIOR ART)

FIG. 18 is a cross-sectional view of a container provided with a container cap according to the conventional prior art.

Figure 19:
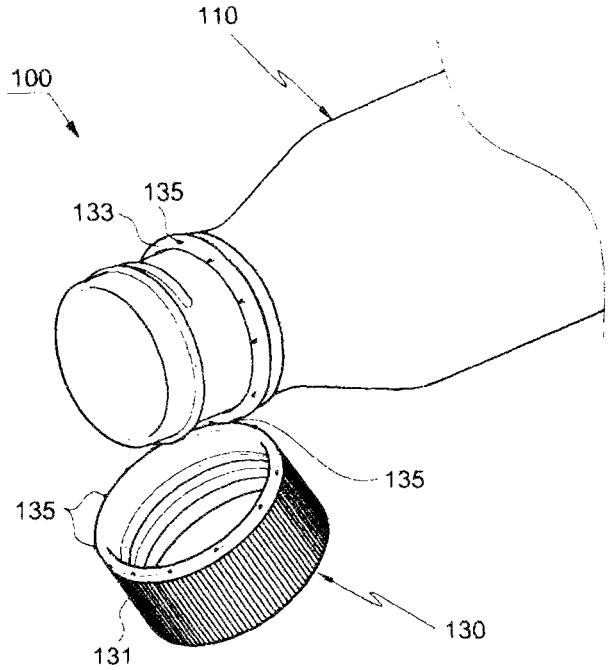
FIG. 19 (PRIOR ART)

FIG. 19 is a perspective view showing a state of opening the container cap from a container of FIG. 18.

Figure 20:
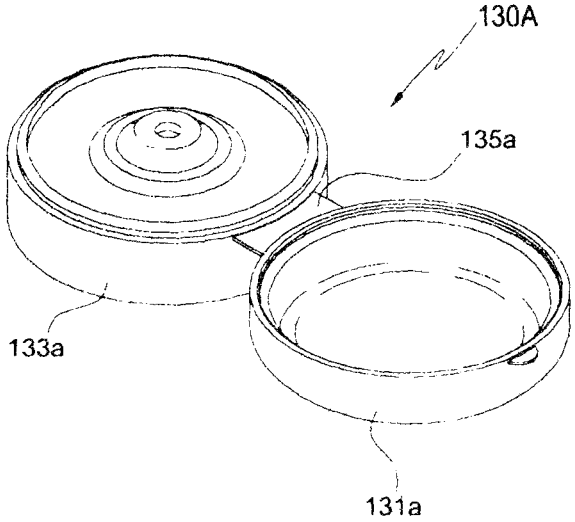
FIG. 20 (PRIOR ART)

FIG. 20 is a perspective view showing an opened state of a conventional prior art one-touch type container cap.

DETAILED DESCRIPTION

A container for preventing loss of a container cap and unintended loose rotation thereof according to respective preferred embodiments of the present invention will be described in detail with reference to the accompanying drawings.

As shown in FIGS. 1 to 7, a container 1A for preventing loss of a container cap and unintended loose rotation thereof, according to a preferred embodiment of the present invention, includes: a container body 10 having a mouth provided with a male screw portion 11; a fixing ring 33 that is prevented from seceding from the container body 10; a container cap body 31 on the inner circumferential surface of which a female screw portion 311 is provided in correspondence to the male screw portion 11 of the container body 10; and a container cap 30 provided with a hinge portion 35 connecting the fixing ring 33 with the container cap body 31, wherein the hinge portion 35 of the container cap 30 includes: a main connector 35*a* that connects the container cap body 31 and the fixing ring 33; and a sub-connector 35*b* formed at either side of the main connector 35*a* and having a narrower width than the main connector 35*a*, wherein a portion of the main connector 35*a* connected to the container cap body 31 and the fixing ring 33 is formed into the same thickness as those of the container cap body 31 and the fixing ring 33, and wherein the main connector 35*a* has an inflection portion 351 that is depressed in a curvature form or in a "v-shaped" form inwardly or outwardly at an intermediate portion in height, to thereby have minimum thickness.

Here, thickness of the sub-connectors 35*b* are preferably formed thinner than those of the container cap body 31 and the fixing ring 33.

That is, as shown in FIGS. 1 to 7, the inner portion of the main connector 35*a* is depressed and the outer portion thereof is evenly extended with no step with respect to the outer circumferential portion of the container cap body 31 and the fixing ring 33. Otherwise, as shown in FIGS. 8 and 9, the outer portion of the main connector 35*a* may be depressed in which the depression may be provided in a curvature form or in a "v-shaped" form not with a step. In addition, no concave step is formed in the inner portion of the main connector 35*a*.

Here, in the case that the outer portion of the main connector 35*a* is depressed, inclined planes 315 and 335 are respectively formed in parts of the outer circumferential portions of the container cap body 31 and the fixing ring 33, on the basis of an inflection portion 351 at which minimum thickness is given (see FIGS. 8 and 9).

The inclined planes 315 and 335 prevent any interference between the container cap body 31 and the fixing ring 33 during opening the container cap, and are provided in a substantial half-moon form in the container cap body 31 and the fixing ring 33.

In addition, the sub-connectors 35*b* are respectively provided in a stepped form at both outer portions of the container cap body 31 and the fixing ring 33, and thus preferably formed thinly in comparison with the container cap body 31 and the fixing ring 33.

As a result, no undercut stepped portion is formed in the inner side of the container cap.

In addition, an inflection groove 351*a* is preferably formed at at least one of the main connector 35*a* and the sub-connectors 35*b*, in order to reinforce flexibility of the inflection portion 351.

It is preferable that the inflection groove 351*a* is concavely formed in the inner side thereof and protrudingly formed in the outer side thereof, and vice versa.

It is preferable that the main connector 35*a* and the sub-connectors 35*b* are formed within the area of the container cap body 31.

In addition, it is preferable that a cutting line 37 for extending a connection length with respect to the container cap body 31 is horizontally formed on the fixing ring 33 in a set section around directly below the hinge portion 35.

The cutting line 37 allows the container cap to be opened while maintaining a state where the container cap body 31 has been connected with the fixing ring 33, at a state where the fixing ring 33 is fixed by a support projection 13 of the container body (see FIG. 6).

In addition, one or more bridges that are cut at the time of opening the container cap are formed between the fixing ring 33 and the container cap body 31, to then enable a user to recognize whether or not the container cap 30 is opened.

In addition, it is preferable that wings 337 that prevent the fixing ring 33 from unintended loose rotation and extend a snug fit tolerance with respect to the container body 10 are radially formed on the inner circumferential surface of the fixing ring 33 (see FIG. 2).

The wings 337 may be provided in various forms such as a horizontal form or an inclined form, and prevent the fixing ring 33 from unintended loose rotation unless an external force is applied, to thus maintain the posture of the opened container cap body, and widen a fit tolerance range between the container body and the fixing ring, to thus widen an adaptable use with respect to the container bodies that have a diverse range of dimension.

The hinge portion 35 according an embodiment of the present invention allows the main connector 35*a* to connect the container cap body 31 and the fixing ring 33 so as to be bent as a main function, in which the sub-connectors 35*b* are provided at both sides of the main connector 35*a*, respectively. Accordingly, the container cap body is elastically pulled and supported at both sides of the main connector 35*a* at the time of opening the container cap, to thus prevent undesired wobbling of the container cap body 31 and maintain a stable open posture of the container cap.

In other words, the sub-connectors 35*b* should be extended in terms of a position in comparison with the main connector 35*a* that is centrally positioned at the time of opening, to thus generate a pulling force and to thereby firmly hold the container cap body 31 so that the opening state of the container cap body 31 does not loosely wobble (see FIGS. 2 and 7).

The reason why the sub-connectors 35*b* are formed in the same length as that of the main connector 35*a* and are narrowly formed in width resides in order to obtain a better flexibility for the function of the hinge portion 35.

In addition, a portion where the main connector 35*a* is connected with the container cap body 31 and the fixing ring 33 is formed in the same thickness as those of the container cap body 31 and the fixing ring 33, so as to have no stepped portion. Accordingly, no undercut portion happens, and an inflection portion 351 is depressed in a curvature form or in a "v-shaped" form at an intermediate portion in height, to thereby easily prevent any deformity during injection molding.

Further, in the case that a depression is formed at the outer side of the container cap (see FIGS. 7 to 9), injection molding becomes further facilitated.

In addition, since the sub-connectors 35*b* are formed thinly with a step with respect to the container cap body 31 and the fixing ring 33 at the outer side of the container cap, any inner undercut portion is prevented from being formed. Even in the case that any stepped portion is formed inwards from the sub-connectors, a width to length is formed differently from the main connector, to accordingly make flexibility better and to thereby prevent deformity after having cooled and hardened during injection molding.

As described above, no step is formed on the inner surface of the container cap due to the hinge portion 35 in the container according to the embodiment 1A of the present invention, to thereby facilitate injection molding at a vertical connection state where the fixing ring 33 and the container cap body 31 are coupled with the container body, and to thus reduce occurrence of inferiorities. In comparison with the conventional art that performs injection molding at a state where the container cap body 31 and the fixing ring 33 are horizontally unfolded due to the undercut portion, an area of a mold necessary for production of a single container cap is reduced to the half or less, to thus double productivity of the mold.

In addition, in the case that the inner surfaces of the main connector 35*a* and the sub-connectors 35*b* in the hinge portion 35 are formed on the same plane as those of the container cap body 31 and the fixing ring 33, the inclined planes 315 and 335 are formed at the outer portions of the hinge portion between the container cap body 31 and the fixing ring 33. That is, at the outer portions of the hinge portion is depressed in a "v-shaped" form in the cross-section thereof, to thus prevent a mutual interference during opening the container cap, and to thereby enable the container cap to be easily opened and stabilize an opening posture of the container cap (see FIGS. 8 and 9).

As shown in FIGS. 10 to 13, according to another embodiment 1B of the present invention, a female screw portion 331 corresponding to the male screw portion 11 of the container body 10 is formed on an inner circumferential surface of the fixing ring 33. Here, indent locking portions 313 and 333 that correspond to each other are formed between the container cap body 31 and the fixing ring 33 at a position corresponding to the hinge portion 35. Here, locks 12 and 332 that correspond to each other are protrudingly formed on an inner circumferential surface of the fixing ring 33 and the upper portion of the male screw portion 11 of the container body, in order to prevent the fixing ring 33 from separating from the container body 10. Here, the locks 12 and 332 are provided in a ratchet form in order not to interfere with rotation of the container cap in a locking direction.

In addition, a holder 15 is protrudingly formed lower than the lock 12 of the container body 10 in which the holder 15 temporarily holds one lock adjacent to the other lock formed on any one of the container body 10 and the fixing ring 33 in order to prevent the container cap from freely rotating backward at a state where the lock 332 formed on the fixing ring 33 is caught by the lock 12 of the container body 10.

The holder 15 constitutes a groove into which one lock 332 is fitted together with the other lock 12, and is protruded lower than the locks so that a rotational operation for opening and closing the container cap is not interfered.

Through the above-described structure, the fixing ring 33 rotationally ascends and descends along the screw threads at a state where the container cap body 31 is mutually coupled with the indent locking portions 313 and 333, and is prevented from seceding by the locks 12 and 332 at the time of opening and closing the container cap. In addition, the holder 15 prevents the container cap that would not move in a secession rotating direction from rotationally move backward by dead weight at the time of opening the container cap.

In the case that a rotational force is applied to the container cap in order to close the container cap, the lock 332 passes over the holder 15 softly to thus prevent a hindrance from being caused at the time of opening and closing the container cap.

In addition, in order to separate and open the container cap body from the fixing ring, it is preferable that a grip 317 is provided in the container cap body.

As shown in FIG. 14, according to still another embodiment 1C of the present invention, a sub-fixing ring 36 that is caught by a support projection 13 that is formed in the container body and that is prevented from moving upward below the fixing ring 33, is additionally provided. Here, one or more bridges 39 that are severed at the time of opening the container cap are formed between the fixing ring 33 and the sub-fixing ring 36.

By the above-described structure, the case that the fixing ring 33 ascends and descends also has a function of displaying whether or not the container cap is opened.

As shown in FIGS. 15 to 17, according to yet another embodiment 1D of the present invention, there is provided a container for preventing loss of a container cap and unintended loose rotation thereof, in which the container includes: a fixing ring 33 that is prevented from separating from a container body 10; a container cap body 31 that opens and closes the container body 10, and on an inner circumferential surface of which a screw portion 311 is formed; a hinge portion 35 that connects the fixing ring 33 and the container cap body 31; and a plurality of bridges 39 that are formed between the container cap body 31 and the fixing ring 33 and are cut at the time of opening the container cap. Here, a cut line 37 for extending a connection length with respect to the container cap body 31 at the time of opening the container cap is formed on the fixing ring 33 in a set section of the circumference of the fixing ring 33 around directly below the hinge portion 35. Here, the hinge portion 35 includes: a stay 35*c* that is extended toward the fixing ring 33 from the container cap body 31, is spaced from the fixing ring 33, and comes into the inside thereof at the time of opening the container cap, to thus maintain the opened state; and connectors 35*d* that connect the container cap body 31 and the fixing ring 33. Here, a plurality of support wings 34 are formed on the inner circumferential surface of the fixing ring 33, in which a cushion pad 360 that is extended from the stay 35*c*, to thus erect upright at the time of being mounted on the container body and elastically support the stay 35*c* at the time of opening the container cap is formed adjacent to the stay 35*c*.

It is preferable that a convex portion 361 for reinforcing an elastic force for supporting the stay 35*c* is formed in the cushion pad 360.

The cushion pad 360 is formed thinly and lengthily as in the case of the support wings 34. Accordingly, when the cushion pad 360 is mounted in the container body, it is folded over the container body and rises up vertically through a space between the container body 10 and the fixing ring 33 so as to be positioned to support the stay 35*c* (see FIG. 17).

In addition, the convex portion 361 is protruded in a direction of pushing the stay 35*c* outwards to thus reinforce a support elastic force.

In addition, a protruding support 358 is preferably formed in the stay 35*c* to thus support the stay 35*c* at the time of opening the container cap, and a stay mounting groove 339 is preferably formed in the fixing ring 33.

According to the function of the embodiment 1D of the present invention, the hinge portion 35 is configured to be extended and protruded from the container cap body 31 toward the fixing ring 33. In addition, the hinge portion 35 is provided with the stay 35*c* that is spaced from the fixing ring 33. In addition, the connectors 35*d* that connect the container cap body 31 and the fixing ring 33 are symmetrically formed at both sides of the stay 35*c*. At the time of opening the container cap, both the connectors 35*d* are bent and angularly transformed while maintaining the connection state elastically so that the container cap body 31 and the fixing ring 33 are not separated from each other, and the stay 35*c* that is positioned at the central portion is not bent and is angularly transformed together with the container cap body 31.

In other words, the stay 35*c* is spaced from the fixing ring 33 as part of the container cap body 31. Accordingly, the stay 35*c* is integrally turned over together with the container cap body at the time of opening the container cap, and the extended and protruded portion of the hinge portion comes into the inner side of the container cap to then support the container body 10 or the fixing ring 33 and to thus maintain the opened state.

In addition, the cushion pad 360 is provided adjacent to the stay 35*c*. Accordingly, the cushion pad 360 elastically support the stay 35*c* at the time of opening the container cap, to smoothly perform an operation of opening and closing the container cap and maintain a stable opening angle of the container cap.

In addition, no step is formed on the inner surface of the container cap due to the hinge portion 35 in the container according to the embodiment 1D of the present invention, to thereby facilitate secession of the core and facilitate injection molding at a vertical connection state where the fixing ring 33 and the container cap body 31 are coupled with the container body, and to thus remarkably enhance productivity of the container cap.

The preferred embodiments of the present invention have been described with reference to the accompanying drawings. Here, the terminology or words used in the specification and claims should not be analyzed to limit the invention to the general or dictionary meanings, but should be analyzed in the meaning and concept adapted for the technological spirit of the present invention. It should be recognized that the embodiments described herein with respect to the drawing figures are meant to be illustrative only but does not represent all the technological spirit of the present invention. It should be understood that there can be various equivalents or modifications that can substitute the embodiments of the present invention at the time of the present application.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

As described above, the container for preventing loss of a container cap and unintended loose rotation thereof according to the present invention smoothly performs an operation of opening the container cap and does not create any undercut portion in the inside of the container cap due to the hinge portion, to thus easily perform injection molding at a state where the fixing ring and the container cap body are vertically connected with each other, and to thereby reduce occurrence of inferiorities. In comparison with the conventional an area of a mold necessary for production of a single container cap is reduced to the half or less.

The invention claimed is:

1. A container for preventing a container cap from being lost and for preventing unintended rotation thereof, the container comprising:

a container body having a mouth provided with a male screw portion;

a container cap provided with a fixing ring that prevents the container cap from separating from the container body;

a container cap body having on an inner circumferential surface thereof a female screw portion provided in correspondence to the male screw portion of the container body; and a hinge portion connecting the fixing ring with the container cap body, wherein the hinge portion of the container cap comprises:

a main connector that connects the cap body and the fixing ring; and a sub-connector formed at either side of the main connector and having a narrower width than the main connector, wherein a portion of the main connector connected to the container cap body and the fixing ring is formed with the same thickness as those of the container cap body and the fixing ring, and wherein the main connector has an inflection portion that is depressed in at least one of a arcuate form or in a V-shaped form inwardly or outwardly at an intermediate portion in height, to thereby have minimum thickness.

2. The container for preventing a container cap from being lost and for preventing unintended rotation thereof, according to claim 1, wherein:

a cutting line for extending a connection length with respect to the container cap body is horizontally formed on the fixing ring in a section where the container cap body can be opened while maintaining a state where the container cap body has been connected with the fixing ring, at a state where the fixing ring is fixed by a support projection of the container body around the hinge portion.

3. The container for a container cap from being lost and for preventing unintended rotation thereof, according to claim 1, wherein:

one or more bridges that are cut at the time of opening the container cap are formed between the fixing ring and the container cap body.

4. The container for preventing a container cap from being lost and for preventing unintended rotation thereof, according to claim 1, wherein:

wings that prevent the fixing ring from idling and extend a fit tolerance with respect to the container body are radially formed on an inner circumference surface of the fixing ring.

5. The container for preventing a container cap from being lost and for preventing unintended rotation thereof, according to claim 1, wherein:

a female screw portion corresponding to the male screw portion of the container body is formed on an inner circumferential surface of the fixing ring, wherein indent locking portions that correspond to each other are formed between the container cap body and the fixing ring at a position corresponding to the hinge portion, wherein locks that correspond to each other are protrudingly formed on the inner circumferential surface of the fixing ring and the upper portion of the screw portion of the container body, in order to prevent the fixing ring from seceding from the container body, and wherein the locks are provided in a ratchet form in order not to interfere with rotation of the container cap in a locking direction.

6. The container for preventing a container cap from being lost and for preventing unintended rotation thereof, according to claim 5, wherein:

a holder is protrudingly formed lower than the lock of the container body in which the holder temporarily holds one lock adjacent to the other lock formed on at least one of the container body and the fixing ring in order to prevent the container cap from freely rotating backward at a state where the lock formed on the fixing ring is caught by the lock of the container body.

7. The container for preventing a container cap from being lost and for preventing unintended rotation thereof, according to claim 5, further comprising:

a sub-fixing ring that is caught by the support projection that is formed in the container body and that is prevented from moving upward below the fixing ring, wherein one or more bridges that are cut at the time of opening the container cap are formed between the fixing ring and the sub-fixing ring.

8. A container for preventing a container cap from being lost and unintended rotation thereof, the container comprising:

a fixing ring that is prevented from separating from a container body; and the container cap having a container cap body that opens and closes the container body, and on an inner circumferential surface of which a screw portion is formed;

a hinge portion that connects the fixing ring and the container cap body; and a plurality of bridges that are formed between the container cap body and the fixing ring and are separated at the time of opening the container cap, wherein a cutting line for extending a connection length with respect to the stopper body at the time of opening the container cap is formed on the fixing ring in a set section of the circumference of the fixing ring around the hinge portion, wherein the hinge portion comprises: a stay that is extended toward the fixing ring from the container cap body, is spaced from the fixing ring, and comes into an inside thereof at the time of opening the container cap, to thus maintain an opened state of the container cap and connectors that connect the container cap body and the fixing ring, and wherein a plurality of support wings are formed on the inner circumferential surface of the fixing ring, in which a cushion pad that is extended from the stay, to thus erect upright at the time of being mounted on the container body and elastically support the stay at the time of opening the container cap is formed adjacent to the stay.

9. The container for preventing a container cap from being lost and unintended rotation thereof, according to claim 8, wherein:

a convex portion for reinforcing an elastic force for supporting the stay is formed in the cushion pad.

* * * * *